US012050080B2

(12) United States Patent
Bowmar

(10) Patent No.: US 12,050,080 B2
(45) Date of Patent: Jul. 30, 2024

(54) BOWMAR NOSE BUTTON

(71) Applicant: Joshua Todd Bowmar, Ankeny, IA (US)

(72) Inventor: Joshua Todd Bowmar, Ankeny, IA (US)

( * ) Notice: Subject to any disclaimer, the term of this patent is extended or adjusted under 35 U.S.C. 154(b) by 122 days.

(21) Appl. No.: 17/935,548

(22) Filed: Sep. 26, 2022

(65) Prior Publication Data

US 2023/0017511 A1 Jan. 19, 2023

Related U.S. Application Data

(63) Continuation-in-part of application No. 17/039,963, filed on Sep. 30, 2020, now abandoned, which is a continuation-in-part of application No. PCT/US2019/006540, filed on Dec. 4, 2019, which is a continuation of application No. 16/378,480, filed on Apr. 8, 2019, now Pat. No. 10,591,244.

(60) Provisional application No. 62/775,283, filed on Dec. 4, 2018.

(51) Int. Cl.
*F41B 5/14* (2006.01)

(52) U.S. Cl.
CPC ..... *F41B 5/1423* (2013.01); *F41B 5/1419* (2013.01)

(58) Field of Classification Search
CPC .... F41B 5/1423; F41B 5/1419; F41B 5/1469; F41G 1/467
USPC ..... 124/87, 90
See application file for complete search history.

(56) References Cited

U.S. PATENT DOCUMENTS 3,199,502 A * 8/1965 Stonecipher ..... F41G 1/467 124/87
3,942,507 A * 3/1976 Opal ..... F41G 1/467 124/35.2
4,421,093 A * 12/1983 Stock ..... F41B 5/14 124/86
4,539,970 A * 9/1985 Griz ..... F41B 5/1423 124/90
4,833,786 A * 5/1989 Shores, Sr. ..... F41G 1/01 42/133
5,107,596 A * 4/1992 Snyder ..... F41G 1/467 124/90
5,379,748 A * 1/1995 Carlson ..... F41G 1/467 124/90
5,666,938 A * 9/1997 Simonds ..... F41B 5/1423 124/90
5,676,123 A * 10/1997 McPherson ..... F41B 5/1419 124/90

(Continued)

*Primary Examiner* — John E Simms, Jr.

(57) ABSTRACT

A method of aiming an archery bow includes the steps of providing a nose button which comprises a longitudinal axis, first and second split rings spaced apart along the longitudinal axis, a plurality of connecting beams spanning between the split rings, and with the second split ring further comprising a radial array of projections with tips residing in a plane perpendicular to the longitudinal axis. With the bowstring drawn, nose button presents one from among its radial array of projections to contact a point on an archer's nose. The button is secured to the string by depositing a cord between the split rings and looping the cord around the bowstring. A gap defined by two adjacent but spaced apart connecting beams and the first and second split rings defines an aperture within which the cord contacts the bowstring with its loops transverse to the axis of the bowstring.

20 Claims, 3 Drawing Sheets

(56) References Cited

U.S. PATENT DOCUMENTS

| | | | | |
|---|---|---|---|---|
| 5,762,059 | A * | 6/1998 | Strope | F41G 1/467 124/90 |
| 6,058,921 | A * | 5/2000 | Lawrence | F41B 5/1419 124/87 |
| 6,363,644 | B1 * | 4/2002 | Frost | G09F 19/12 40/538 |
| 7,040,027 | B1 * | 5/2006 | Shaffer | F41B 5/1419 124/87 |
| 7,753,043 | B1 * | 7/2010 | Eckert | F41B 5/1469 124/35.2 |
| 9,713,322 | B2 * | 7/2017 | Yamamoto | A01K 87/00 |
| 10,345,072 | B1 * | 7/2019 | Webster | F41B 5/1411 |
| 10,591,244 | B1 * | 3/2020 | Bowmar | F41B 5/1423 |
| 2007/0050998 | A1 * | 3/2007 | Myers, Jr. | F41G 1/01 33/265 |
| 2007/0119060 | A1 * | 5/2007 | Grace | F41B 5/1419 33/265 |
| 2008/0216331 | A1 * | 9/2008 | Jones | F41G 1/467 124/87 |
| 2009/0307914 | A1 * | 12/2009 | Behr | G01C 3/02 356/8 |
| 2011/0265778 | A1 * | 11/2011 | Bach | F41B 5/1426 124/92 |
| 2016/0169613 | A1 * | 6/2016 | Wolf | F41B 5/1419 124/87 |
| 2017/0082401 | A1 * | 3/2017 | Wolf | F41G 1/467 |

* cited by examiner

BOWMAR NOSE BUTTON

CROSS REFERENCE TO RELATED APPLICATIONS

This non-provisional utility application is a continuation in part of non-provisional utility application Ser. No. 17/039,963 "Bowmar Nose Button," filed 30 Sep. 2020, which is a continuation in part of international (PCT) Patent Application PCT/US19/64540 "Bowmar Nose Button," filed 4 Dec. 2019. International (PCT) Patent Application. PCT/US19/64540 "Bowmar Nose Button," filed 4 Dec. 2019 is a continuation of U.S. non-provisional utility application Ser. No. 16/378,480 "Bowmar Nose Button," filed 8 Apr. 2019 and issued 17 Mar. 2020 as U.S. Pat. No. 10,591,244. Another continuation-in-part utility application Ser. No. 16/820,394 "Bowmar Nose Button" was filed 16 Mar. 2020 proceeding from U.S. non-provisional utility application Ser. No. 16/378,480 and issued 13 Jul. 2021 as U.S. Pat. No. 11,060,817. U.S. non-provisional utility application Ser. No. 16/378,480 "Bowmar Nose Button," filed 8 Apr. 2019 also claims priority to U.S. Provisional application 62/775,283 "Nose Button" filed 4 Dec. 2018.

The entire contents of U.S. Provisional Patent Application 62/775,283 "Nose Button" filed 4 Dec. 2018, U.S. non-provisional utility application Ser. No. 16/378,480 "Bowmar Nose Button," filed 8 Apr. 2019, international (PCT) Patent Application PCT/US19/64540 "Bowmar Nose Button," filed 4 Dec. 2019, U.S. utility application Ser. No. 16/820,394 "Bowmar Nose Button" filed 16 Mar. 2020, and U.S. non-provisional utility application Ser. No. 17/039,963 "Bowmar Nose Button," filed 30 Sep. 2020, are hereby incorporated into this document by reference.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention relates to using an aiming aid for target archery and bow hunting.

BACKGROUND

In archery, the point of impact of an arrow and its tip is influenced by several simultaneous parameters, most notably the distance to which the bowstring is drawn back and the elevation angle at which an arrow is launched.

An archer must develop a skill set which combines a keen sense of proprioception and "muscle memory" in various body positions in order to make a good estimate of both how far back an arrow nocked to its bowstring has been drawn and also the elevation angle of the arrow. Accuracy is gained by repeated visceral learning experiences of which muscle positions of the entire body result in which ranges and impact points of the arrows. According to some techniques, an archer sights along an arrow shaft, but in other techniques the arrow axis at launch is offset from a line of sight from the archer's aiming eye to the target or to an aiming structure on the bow, arrow, or string, so that the repeatable control of a launch angle must also be learned by experience and muscle memory which is not often or easily transferrable from one bow and arrow system to another, nor easily transferable from one user to another user of the same system. Thus, despite its ancient history, many challenges for repeatability and reproducibility remain unsolved in the field of archery.

BRIEF DESCRIPTION

Many existing sighting aids for archery help correlate distance of impact only to an elevation angle at which a bow is held, but without regard to any particular anchor point in relation to the face to bowstring contact. A "sight picture" is composed of a visual image or view of the bow parts and arrow parts in the near field combined with the view of the target at a distance.

It is disadvantageously possible for a user of an archery sighting system to create the same "sight picture" while the energy stored in the bow varies, which results in the same sight picture yielding different arrow impact points. It is therefore a primary objective of the invention to offer a new way of using a sighting device so that an equivalent sight picture to that of a previous shot provides results much more nearly the same impact point as the previous shot.

Another objective of the invention is to provide a method by which an archer may repeatably establish the same anchor point and face to string contact of a bow from one shot to the next, providing that other variables such as arrow length and mass are reasonably similar. A corollary objective of the invention is to enable a user to reestablish the same anchor point, sight picture, head position, positions of the bow, the eye, the arrow and its tip, and any sighting structures in the vicinity of the grip or arrow rest, so that whenever these visual components are arranged the same as for a previous shot with the same arrow, then the same point of impact for the arrow may be expected and achieved.

Another corollary objective of the invention is to provide tactile feedback to the archer by which improper form or errors in technique are discouraged by making these undesirable methods noticeable less comfortable than preferred and effective proper forms and techniques.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF CERTAIN EMBODIMENTS

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise. The indefinite articles "a" and "an" in claims and elsewhere shall be taken to mean "at least one" in number or in quantity.

Although archery for sport, for hunting to procure food, and for waging war predates written history, accessories and methods have developed and evolved over time and new inventions continually contribute to and improve the art and skill of archery, beginning with the basics of storing mechanical energy in a bow, temporarily coupling a nock of an arrow to the bow, resting a forward portion of the arrow on a portion of the bow, and releasing the stored energy so that it is transferred into substantially longitudinal acceleration of the arrow, which then flies to a target or intended point of impact and is usually stabilized while in flight.

Figure 1:
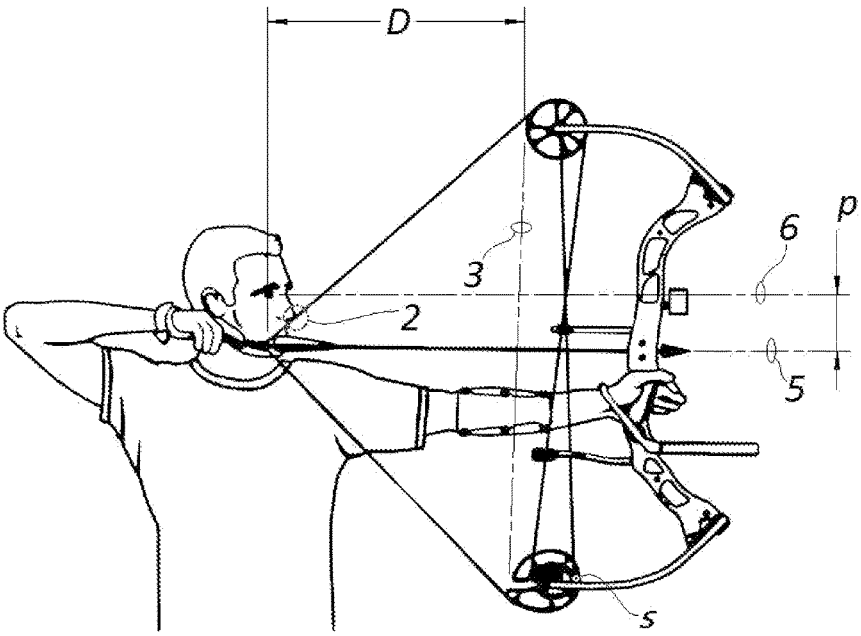
FIG. 1 shows an archer holding a bow in a drawn position and using some contemporary archery accessories.

FIG. 1 shows an archer holding a bow in a drawn position and using some contemporary archery accessories, including an arm guard and a wrist release. Phantom line [3] represents a bowstring in a slack position, and dimension 'D' defines a depth of draw from the slack position to a drawn position when the archer, at full draw with the established anchor point, will be visually aiming the bow and its nocked arrow. Typically the line of sight [6] from the archer's eye to the target is offset from the longitudinal axis [5] defined by a nocked and drawn arrow. Axis [5] may also be called the shooting axis of the bow. The line of sight and the arrow's axis are nearly parallel in most cases except in extreme distance shooting or other unusual circumstances, so that a linear dimension of parallax 'p' may be defined between these axes [5] and [6.] An archer must develop skill in compensating for parallax so that while sighting a target an impact point may be visually estimated. Some bows have sighting aids such as beads mounted on horizontal studs protruding from the bow and usually mounted above the bow grip.

Most modern compound bows may be fitted with a draw stop which halts the paying out of bowstring from the pulleys of the bow. Some of these stops work by obstructing the rotation of a pulley past a certain point and others may work by affixing a bead at a point on the bowstring ahead of a constricted passage along the path of the bowstring so that paying out of the bowstring is halted when the bead encounters the constriction. Draw stops themselves are outside the scope of the invention. Once a draw stop is correctly fitted and adjusted, the depth of draw with an established anchor point, the geometry of the bow, and a nocked arrow held therein are reliable and repeatably fixed from one shot to the next.

The invention comprises a method of use of an archery aiming aid which clamps onto a bowstring at a position whereby an archer may draw the bow so that the bead contacts the archer's nose. Using a nose button in accordance with the invention, an archer is able to hold a bow in a repeatable configuration or geometry comprising outstretched limbs and relative positions of the hands, the bow grip, the depth of draw of the bowstring as controlled by a draw stop, the apex of the drawn bowstring and an arrow nocked therein, and other factors relating to the mechanical energy stored in the bow and imparted to the arrow when released.

With practice, an archer is able to build muscle memory so that from one shot to the next the archer may repeatably re-establish the same stored energy geometry in the body and bow, and repeatably re-establish the same anchor point parallax between the archer's line of sight and the shooting axis of the bow so that improved uniformity of trajectories is achieved, point of impact is learned and controlled more accurately, and thus the archer's accuracy and effectiveness is increased. The use of a nose button firmly mounted to a bow-string may aid greatly in re-establishing the geometrical parameters that define the relationship between a line of sight and the trajectory of an arrow released, and a point of impact within the effective range of the archery system.

Figure 2A:
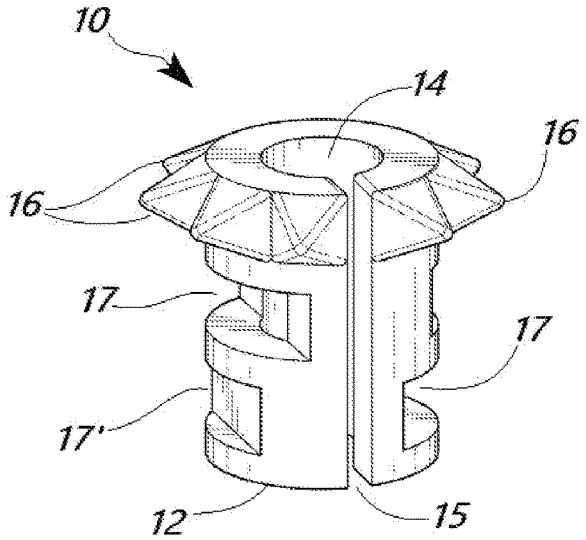
FIG. 2*a* shows an embodiment of a nose button used in accordance with the inventive method.

FIG. 2*a* shows an embodiment of a nose button [10] used in accordance with the inventive method. The bead comprises an open seam tube [12] that defines a longitudinal axis. An open seam tube in this specification is also called a split tube and is a tube with a split, gap, or a slit [15] that extends over its the entire length. The bead has an interior passage or lumen [14] which also extends the entire length of the bead. A radially spaced array of radial projections [16] extend radially outward and substantially perpendicular to the longitudinal axis of the bead. Each projection further defines its own axis of projection, and in a preferred embodiment in accordance with the invention the radial projections all lie in a plane perpendicular to the longitudinal axis of the split tube, so that regardless of the twist of the bowstring or the angular orientation of the bead, when the bowstring is drawn and all other parameters are re-established, the bow will shoot the arrow so that it will fly to a predictable and repeatable point of impact. Side cuts [17] in the wall of the tube may be made deep enough to communicate with the lumen, or may be made as shallow cuts [17'] which do not communicate with the lumen.

The side cuts improve manufacturability in injection molding and also provide seating for when it is desired to securely anchor the bead in position along a bowstring by tightly looping a number of turns of cord around the tube and knotting the cord securely. The turns of cord will shift while being tightened and seat themselves securely within the side cuts. Depending on the elastomeric properties of the bead material, it may be preferable to tighten the loops of cord enough to visibly deform the bead as it is forced to clamp down on the bowstring. In a best mode use, the nose button is adjusted and located to a point on the bowstring so that it contacts a point on the archer's nose.

Figure 2B:
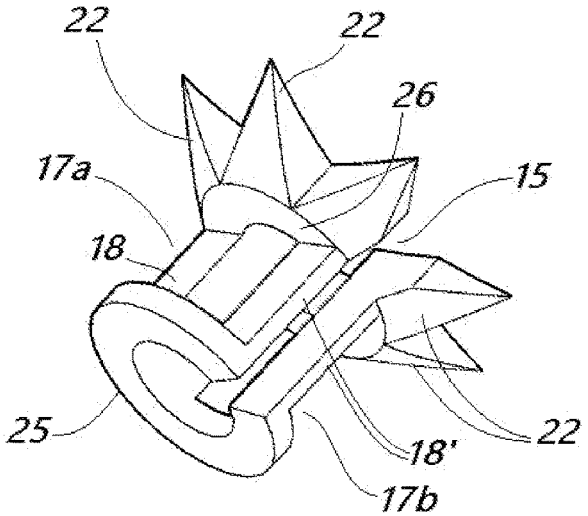
FIG. 2*b* shows an alternative embodiment of a nose button used in accordance with the inventive method.

FIG. 2*b* shows an alternative embodiment of a nose button used in accordance with the inventive method. In this embodiment a first split ring [25] and a second split ring [26] are connected by beams [18, 18'] which define and bestride the gap [15] of the split which runs along the entire length of the bead. The intervening spaces [17*a*, 17*b*] in the cylindrical portion of the tube may be used for receiving anchoring cordage as explained previously. This embodiment also includes a radial array of tapering projections radially spaced around the rim of the second split ring with forward facing positively curved spherical surfaces [22] which in this embodiment are all concentric and of equal spherical radius.

Figure 3A:
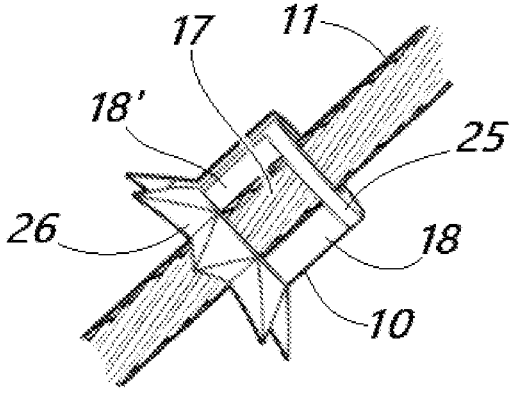
FIG. 3*a* shows the alternative embodiment of the nose button FIG. 2*b* installed on a bowstring as an intermediate step in the inventive method of use for this product.

FIG. 3*a* shows the alternative embodiment of the nose button [10] of FIG. 2*b* installed on a bowstring as an intermediate step in the inventive method of use for this product. The type of nose button shown comprises a longitudinal axis generally coaxial with the bowstring [11,] a first split ring [25] and a second split ring [26] spaced apart along the longitudinal axis. A plurality of connecting beams span between the first and second split rings, with the second split ring further comprising a radially spaced array of radial projections [16,] and with the tips of at least two of the projections residing in a plane perpendicular to the longitudinal axis. The set of connecting beams are radially spaced apart, so that a gap [17] between a first connecting beam [18] and a second connecting beam [18'] from among the plurality of connecting beams, and the first and second split rings define and form a perimeter of an aperture [17.]

Figure 3B:
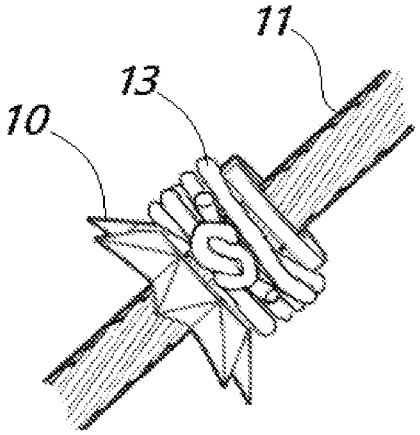
FIG. 3*b* shows the nose button of FIG. 2*b* secured to a bowstring by a cord having at least one loop transverse to and in contact with the axis of the bowstring.

FIG. 3*b* shows the nose button [10] of FIG. 3*a* secured to a bowstring by a cord [13] having at least one loop transverse to and in contact with the axis of the bowstring [11.] In this specification the words 'cord,' 'cordage,' and 'serving' are used interchangeably. The cord is installed and secured by depositing the cord at a location between the split rings and looping it around the bowstring. The gap defined by two adjacent but spaced apart connecting beams and the first and second split rings defines an aperture within which the cord contacts the bowstring with its loops transverse to the axis of the bowstring. Preferred types of knots in the cord for locking the cord loops against the bowstring include an overhand knot, a double overhand knot, a square knot, a bowline, and a clove hitch. In a preferred installation, when the loops of serving are drawn tight during the knot tying process or step, they impinge upon the outer surfaces of the collection of strands which comprise the bow-string to create a friction stop which effectively resists sliding along the bowstring, thus anchoring the nose button at its desired location. Simply put, this arrangement of transverse loops drawn down tightly across portions of the bowstring allow the nose button to grip the bowstring more tightly than internal hoop stress of several wraps of cord around the outside of a cylindrical bead. This installation step does not require any tools, neither conventional, typical hand tools nor specialized tools, nor expensive equipment such as a bow press, which compresses the bow to allow the user to remove the string.

Using a bow press correctly requires years of training and learning. With earlier products such as a bead with a hole in it for the bowstring to pass, a bow owner would have to procure a bow press, become adept with it, and then to attempt by trial and error to locate its desired location along the string. Every minor adjustment would require repeating the disassembly and re-assembly steps of the bow in the bow press. The same sort of trial and error using expensive equipment would be required to locate a bead at its most useful point along the length of the bowstring. Access to and competent use of a bow press for a succession of trial and error repositionings, either for adjusting angular orientation of a laterally extending feature or axially locating an object at a desired point along a bowstring, is an expert level of skill beyond the "person of average skill in the art." Steps involving a bow press are not included or recited in the inventive method because the lengthwise slit of the Bowmar nose button and its split rings allow it to be installed onto a taut bowstring without needing expensive equipment, the training to use it, and without the exacting steps taking down and resetting a bow to move a bead. The need to use expensive equipment and ponderous repetitions is alleviated by the inventive method.

Figure 4:
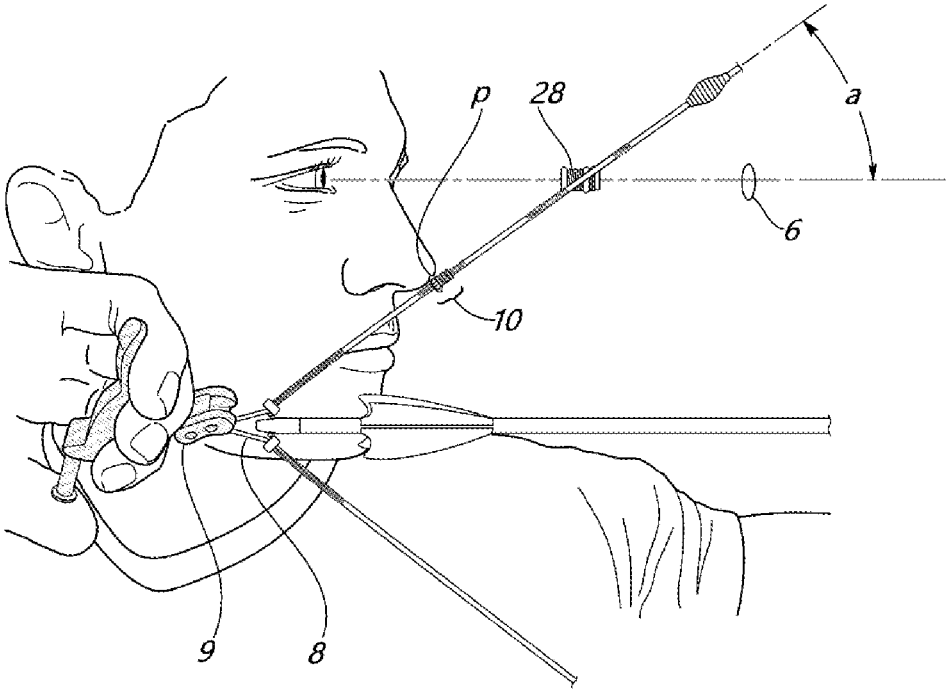
FIG. 4 shows a portion of a nocked and drawn arrow and bowstring with an archer using a peep sight and nose button in accordance with the inventive method.

FIG. 4 shows a portion of a nocked and drawn arrow and bowstring with an archer using a peep sight [28] and nose button [10] in accordance with the inventive method. Modern archery accessories control the location along the bowstring of a nocked arrow by means of a D-loop [8] which also provides a releasable attachment site for a modern archery release aid [9.] These release devices separate the muscular task of holding the bowstring in tension at its depth of draw from a fine-motor skill task of tripping a sensitive release mechanism.

A peep sight is a tube mounted within a bowstring, and may include optical elements such as lenses or filters. Typically the strands of a bowstring are splayed apart so they pass around opposite sides of the tube body, and the tube body is mounted at an angle [a] with respect to the axis of the string, chosen so that when the string is drawn the axis of the tube becomes aligned with some other aiming aid such as a pin mounted on the frame of a compound bow, or some other secondary reference point. Angle [a] is commonly set at 45° or 38° with 38° being more popular, but an archer may prefer other angles. A line of sight [6] extending through the peep sight is used to infer a point of impact for the arrow at a known range. In this specification the frame of a bow means any of the substantially rigid structures but excluding flexible limbs or elastic members for storing energy to be transferred to the arrow.

The archer orients the bow and drawn arrow so that while sighting a target through the peep sight, a projection of the nose button contacts the shooters nose near the distal tip or bulb of the nose and on the underside of the bulb or tip. This point on the nose is usually the most memory sensitive to touch, and with experience a shooter may repeatably touch a nose button projection to the same point on the nose within about 1 mm (about 0.040 in) of locational accuracy. The repeatability of establishing an anchor point on the nose underpins all the other factors involved with sending an arrow where it is wanted to go.

An additional benefit the nose button provides for the archer is to give shooter error feedback before the arrow is released. The inventor knows of no other product in the world that achieves this benefit. Tactile feedback from the spikes at the sensitive portion of the tip of the nose convey an unanticipated and exceptionally high sensory acuity such that an archer is able to discern minute differences in string pressure from the face, and variations of in the bows anchor point become dramatically noticeable. Until this product was invented, an archer would have to shoot first and if he or she missed, would have to wonder and guess at what caused the error in the shot.

Experiments with the invention have revealed that variation in facial pressure from contact of the bowstring to the face is a leading cause of missing in archery. Although initially counterintuitive, when a compound bow is held at full draw the string is under less than a maximum amount of tension because of the mechanical leveraging in the cams. For example, most modern compound bows have 80-85% "let off," which means that at full draw the string tension is 80-85% lower than a peak tension occurring elsewhere over the draw length. However, although let off allows the archer to hold the bow for much longer than a recurve or other standard bow lacking a let off, a new problem is introduced because with 85% of the string tension gone at full draw becomes very easy for the archer to press his or her face into the bowstring and laterally deflect the bowstring, causing an inaccurate shot.

The inaccuracy occurs because once released the bowstring laterally returns to its neutral plane position. As with any step change response in a mechanically damped elastic system, the string may even laterally overshoot during its excursion to its natural center. These lateral wiggles of the bowstring introduce unwanted lateral motions applied at the tail of the arrow while it is accelerating on takeoff from the bow, and thus cause the arrow to fly errantly. The source of this problem is called facial pressure.

The nose button solves the facial pressure problem by means of its spikes. The more a user presses into the string the more uncomfortable it becomes, giving the user immediate and continuous feedback of improper form before releasing the arrow. If an archer moves in some other way that lessens pressure onto the bowstring, the user will also feel instant tactile feedback. Another problem in form is called "creeping" or "head creep," which happens when an archer holding at anchor and full draw fatigues slightly and allows the nocked arrow to travel forward, even slightly, before releasing a shot. Using the inventive method, any slight forward travel of the nocked arrow is instantly detected at the archer's nose where at least one spike is indented. The substantial loss of stimulation felt by reduced pressure at a point of the spiked nose button is detectable even for very slight forward creep of the nocked arrow. Repetition of proper form is key to improvement in any sport. The nose button's spikes improve an archer's ability to make perfect shots, shot after shot, because of the consistent feedback it provides about the archer's form, and how the outcome of a shot changes as the archer's form changes.

For maximum accuracy while using the invention for shooting a bow and arrow, an archer establishes a consistent set of "anchor points," which are points of contact with the archer's face. Contact with a taut bowstring and the face may create an ambiguous contact sensation when more than a small portion of the string lays along or embeds into the flesh of the face, because the contact interface becomes a long ellipse instead of a small, focused point. The inventive method includes using a nose button to provide a best mode "anchor point" for an archer to repeatedly achieve the exact same facial contact point shot after shot, and solves the problem of inconsistent parallax between the archer's line of sight and the shooting axis of the bow. Extreme precision in establishing an anchor point of a particular point on the bowstring to a particular point on the shooter's nose advantageously results in extreme accuracy for the shooter. In comparison to the width of an unadorned bowstring touching the nose, the locational accuracy of detecting the protuberant points of the invention may be enhanced by about 6 times more precision because the width of the contact point of the nose button to the face is less than 1 mm.

Figure 5:
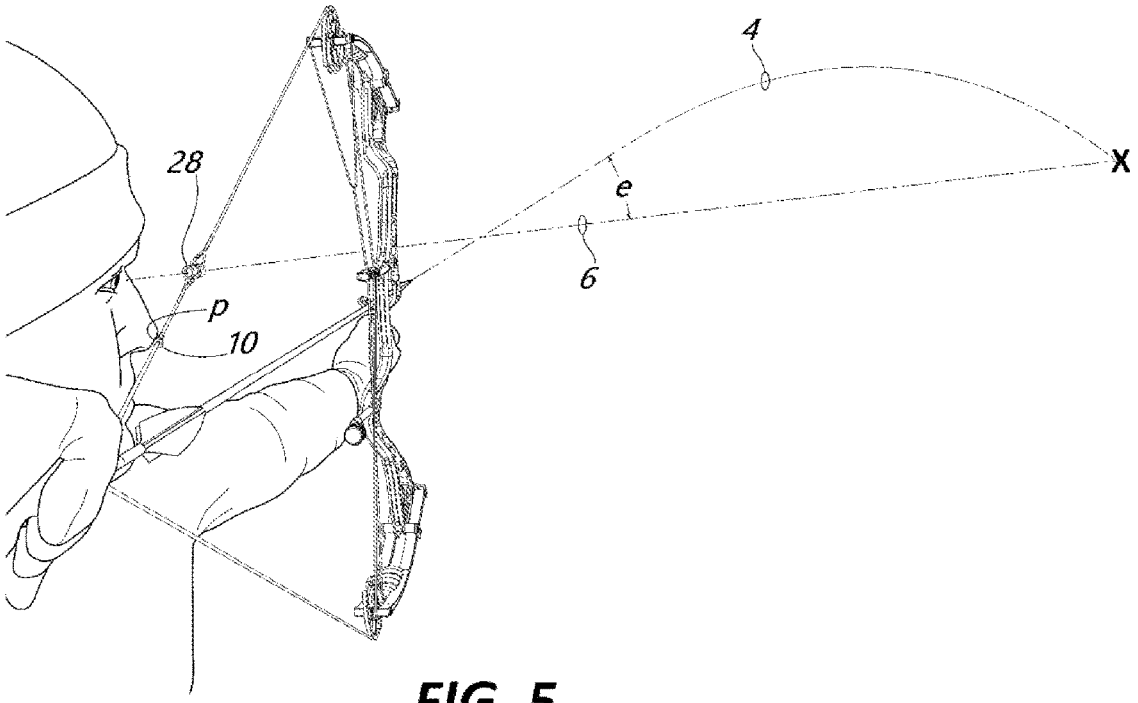
FIG. 5 shows an archer in the same drawn and ready position as seen in FIG. 4, but viewed from behind and slightly to the side of the archer.

FIG. 5 shows an archer in the same drawn and ready position as seen in FIG. 4, but viewed from behind and slightly to the side of the archer. Angles and proportions in this view are distorted for emphasis of the concepts presented. The archer has necked an arrow, drawn the bow, and is now aiming by peering through a peep sight [28] at a distant impact point [X.] The line of sight [6] from the archer's eye to the target passes through the peep sight and may also include a second sighting aid such as a bead on a pin mounted on the bow frame, or a marking on the bow frame or elsewhere. To overcome gravity, the axis of the arrow is held at an elevation angle [e] above the line of sight to the target. When released, the arrow will fly a parabolic arc [4] above the line of sight and arrive at the target. More complex adjustments may be made such as for pre-compensating for crosswinds or for leading a target in motion. The final and most important anchor point for orienting the bow and arrow with respect to an impact point is secured when any one of the projections [p] of the nose button [10] touch and are felt by the archer at the sensitive underside portion below the tip of the nose.

Figure 6:
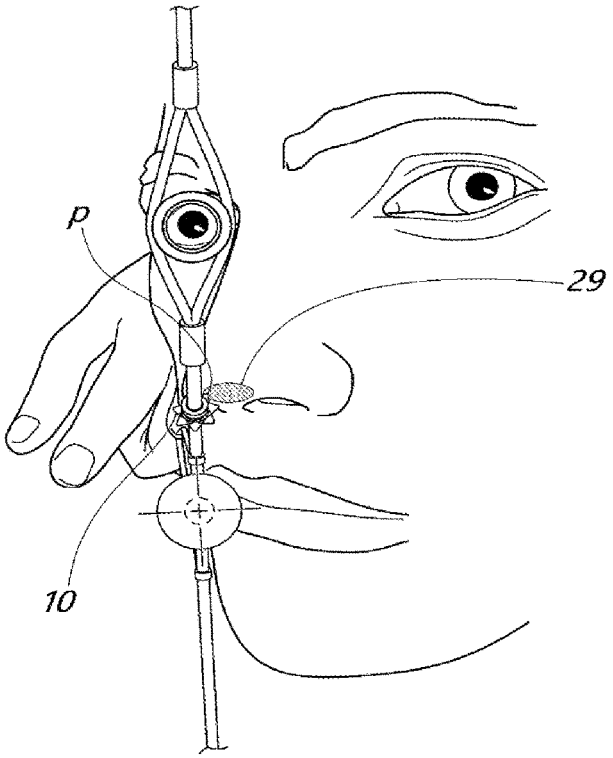
FIG. 6 shows a front view of an archer sighting through a peep sight and projections of a nose button touching within the sensitive underside portion below the tip of the nose.

FIG. 6 shows a front view of an archer sighting through a peep sight and a projection [p] of a nose button [10] touching within the sensitive underside portion below the tip of the nose. The zone of enhanced sensitivity of the nose is indicated by the shaded region [29.]

Figure 7:
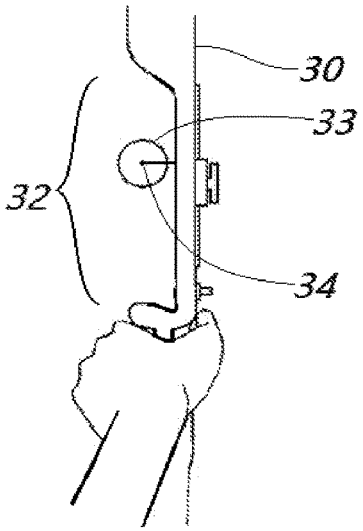
FIG. 7 shows a rear view of a sighting aid mounted on the frame of a bow.

FIG. 7 shows a rear view of a sighting aid mounted on the frame of a bow. The frame [30] has a cutout in its width commonly called a sight window [32,] where various sighting aids may be mounted. Common sighting aids are objects mounted on cantilevered beams or pins extending from the bow frame into the sight window. Sighting aids may include a ring [33,] or a bead [34] mounted at the tip of a pin, and may include optical lenses or filters as well. A sighting aid may also be as simple as a mark made on the bow frame.

The inventive method includes the steps of (a) providing a bow having a bowstring and preferably at least one sighting aid which may be a peep sight installed at a point along a bowstring, or a sighting aid such as a bead, lens or loop mounted on the frame of the bow, or mounted on a projection extending from the bow frame, or a mark on the bow frame. It is also possible to employ the method using a traditional or recurve bow as well. The archer using traditional equipment may optionally touch the bowstring to the archer's forehead while holding the drawn bow.

Also provided is (b) a nose button installed at a different point along the bowstring, with the nose button comprising a tube body and least one radial projection extending from the tube body, but is preferably one from among an angularly spaced-apart array of a plurality of projections whose tips all reside in a plane perpendicular to a longitudinal axis of the tube. In this specification the nose button is installed at a first point on the bowstring and the peep sight, if used, is installed at a second point on the bowstring.

The method is also available to practice with a nose button as seen in FIGS. 2*b*, 3*a*, and 3*b*: comprising a longitudinal axis, first and second split rings spaced apart along the longitudinal axis, a plurality of connecting beams spanning between the first and second split rings, with the second split ring further comprising a radially spaced array of radial projections, with each projection, and with tips of at least two of the projections residing in a plane perpendicular to the longitudinal axis.

An archer or user of the method then (c) inserts the bowstring into the split of a split-seam tube, or into the splits of the two split rings to install the nose button onto the bowstring. The archer then draws the bowstring to a depth of draw which is preferably controlled by a draw stop. For practice, the sighting method may be used without an arrow, while for shooting, an arrow is nocked to the bowstring and if a wrist release is used, then this device is engaged to a D-loop in the bowstring before it is drawn.

The archer then (d) secures the nose button to the bowstring by depositing a cord between the first and second split rings of the nose button and looping the cord around the bowstring to form at least one loop transverse to the bowstring, and (e) draws the bowstring to a depth of draw, optionally limited by a draw stop mechanism in the bow.

Once the bowstring is drawn, the user of the method (f) raises the drawn bow so that a projection of the nose button touches the underside of the tip of the nose, and then orients the drawn bow so that at least one sighting aid aligns with a line of sight extending from the shooter's eye.

The inventor includes supplemental remarks re-emphasizing the must salient benefits of the use of his inventive nose button as shown and described herein, and in comparison to other similar-looking devices or mouth-contact devices such as a "kisser." The invention is designed to interact with the surface of the nose and not the mouth. The inventor discovered that the tip of the nose at its underside is much more sensitive that other parts of the face for "localization," i.e, the ability to detect and remember a first point of contact on the face, and then touch the face a second time as close as possible to that first point of contact. His testing, sometimes done with or by Levi Morgan (who has claimed 15 world championship prizes about 65 US national championships at this writing) showed that in his estimation, the localization of that portion of the nose is accurate within 1 mm, or even less in some conditions, and increased his accuracy on target by a factor of 6. The inventor names this ability "micro anchoring" and no other product or method of use achieves this level of exactitude in localization of an anchor point on a bowstring to the nose or to any other part of the face.

The location of a contact point on the mouth is dependent on the tensions residing within nine muscles of the face. Emotions during a competition or the exhilaration of a decision to take a game animals life easily perturb a human facial expression. Objects which rely on localization to the mouth are subject to error and displacement caused by any changes in the contortion of any of the muscles of the mouth.

The nose is controlled primarily by only three muscles which, being substantially smaller than the muscles of the mouth and substantially fewer in number, mean that the displacement of an origin point on the nose under the influence of muscular action, especially as driven my emotion or stress, is very much less than the perturbation of a location point associated with the mouth. Kisser bead devices categorically cannot be compared to a nose contact device for setting an anchor point in archery.

Preferred embodiments of the nose buttons as depicted herein may weigh about 0.9 grains (0.058 grams.) The larger type of embodiment shown in FIG. 2*a* may weigh about 2.2 grains (0.143 grams.) A traditional kisser button weighs 14 grains (0.907 grams.) The smaller style of nose button depicted herein is thus nearly 15 times lighter than a kisser button. The reduced added mass to the bowstring allows it to accelerate an arrow quickly and to a higher outbound velocity.

When a nocked arrow is drawn, the bowstring is formed into an apex at the arrow nock. This point travels the most and accelerates fastest when the arrow is released. The opposite ends of the active portions of the bowstring near the pulleys of a compound bow, or near the limb tips of a traditional bow, move the least and accelerate the least. Thus any additional mass attached to a bowstring adds unwanted inertia to the whole system under acceleration, and the closer to the nock the object is located, the more its mass will delay the acceleration of the arrow. Thus a peep site added at eye level delays an arrow much less than an object of the same mass attached at the nock. The inventor has observed a bowstring assembly with his nose button achieving arrow velocities 4 to 5 feet per second faster that the same assembly fitted with a typical kisser button.

Similarly, since a nose button resides further up the bowstring than a mouth-contact object such as a kisser, the nose button of the disclosed method allows faster bowstring acceleration than any kisser button. Faster arrows reach a moving target in less time and thus require less leading and less holdover, and simplifying these mental calculations allows quicker target acquisition, which is a competitive edge in timed sporting events and an overall advantage in hunting. Achieving proper form faster and acquiring a target solution more quickly and releasing a shot sooner all advantageously shorten the time which an archer must maintain muscle force at full draw. The longer an archer must hold at full draw, the more difficult it becomes to aim. Releasing an arrow sooner avoids the unwanted situation where muscle fatigue deteriorates accurate shooting.

Observations by the inventor using the invention himself and observing others using his invention allow him to estimate that targeting with a nose button, from the time of setting the anchor to the archer's face to stabilizing the desired sight picture with a drawn arrow and the sighting aids aligned on target is reduced by at least 25% to 50%. Normally for a novice archer it takes about 12 to 15 seconds between setting an anchor and achieving an aimed sight picture on target. For accomplished archers this time duration is about 7 to 10 seconds. However, using the inventive nose button and method, an archer may achieve proper anchor and targeting within 2 to 5 seconds.

The contact area to the face is 1 $mm^2$ or less, while for a kisser button the contact area may be around a ¼ inch diameter (31.7 $mm^2$.) The Bowmar Nose button for the method disclosed herein produces not only a substantially smaller point stimulus to for the archer to detect, but it is applied to a point on the face where sensitivity to localization is much more accurate as well. The product is the only one of its type which delivers immediate tactile sensation that gives a archer real-time feedback of improper form before the arrow the released. The worse an archer's form, the more uncomfortable is the archer's feedback from the contact point indenting into the tip of the nose which the inventor has first discovered is more sensitive to location of contact than any other portion of the face.

Unintentional contact of the archer's head to other parts of the bowstring are detrimental to accuracy and the technique of shooting an arrow. An archer may unknowingly lean a portion of the face onto the side of the bowstring. This error in form produces two unwanted effects: first, when released, the bowstring slides across that potion of the face being leaned onto it, which generates not only an unpleasant experience to the archer, and second, the lateral pressure on the bowstring and the nocked arrow at the beginning of its acceleration laterally perturbs the flight of the arrow to its target.

Since initial contact upon a pointed or spiked object is not only readily detectable as a tactile stimulus, but further embedding of the apex of the object into the body rapidly transitions from a neutral notice of contact to an unpleasant or painful stimulus, the Bowmar nose button provides instant feedback if an archer were to push into the string and introduce any substantial amount of unwanted pressure on the bowstring, because the unwanted pressure "goes both ways."

While certain features and aspects have been described with respect to exemplary embodiments, one skilled in the art will recognize that numerous modifications are possible. Also, while certain functionality is ascribed to certain system components, unless the context dictates otherwise, this functionality may be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems.

The present disclosure is not to be limited in terms of the particular embodiments described in this application, which are intended as illustrations of various aspects. Many modifications and variations may be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Thus, unauthorized instances of apparatuses and methods claimed herein are to be considered infringing, no matter where in the world they are advertised, sold, offered for sale, used, possessed, or performed.

Consequently and in summary, although many exemplary embodiments are described above, it will be appreciated that the invention is intended to cover all modifications and equivalents within the scope of the following claims.

What is claimed is:

1. A method for aiming an archery bow, comprising the steps of:

(a) providing a bow having a frame and a bowstring, (b) providing a nose button which comprises an open seam tube that defines a longitudinal axis and a slit extending over its the entire length, first and second split rings spaced apart along said longitudinal axis, the open seam tube spanning between said first and second split rings, with said second split ring further comprising a radially spaced array of radial projections, with tips of at least two of said projections residing in a plane perpendicular to said longitudinal axis, and at least one side cut in said tube between said first and second split rings which further define an aperture, (c) inserting said bowstring into said slit and into said splits of said split rings and locating said nose button to a first point on said bowstring so that when drawn, one from among said radial array of projections contacts a point on an archer's nose, (d) depositing a cord onto said tube between said first and second split rings and looping said cord around said bowstring to form at least one loop transverse to said bowstring and in contact through said aperture with said bowstring, (e) drawing said bowstring to a depth of draw, and (f) raising said bow so that one from among said tips of said radial projections touches said archer's nose.

2. The aiming method of claim 1, further comprising a step (g) after step (f) of:

orienting said bow so that at least one sighting aid affixed thereto aligns with a line of sight extending from said archer's eye.

3. The aiming method of claim 1, wherein said depth of draw which is controlled by a draw stop.

4. The aiming method of claim 1, wherein any one of said at least one sighting aid is selected from the set of sighting aids consisting of:

a peep sight installed at a second point along a bowstring, a bead mounted on said bow frame, a lens mounted on said bow frame, a loop mounted on said bow frame, a bead mounted on a projection extending from said bow frame, a lens mounted on a projection extending from said bow frame, a loop mounted on a projection extending from said bow frame, and a mark on said bow frame.

5. The aiming method of claim 4, wherein said sighting aid is a peep sight, and further comprising a step (b-1) after step (a) of splaying apart strands of said bowstring so that they pass around opposite sides of said sighting aid.

6. The aiming method of claim 5, wherein said peep sight comprises a tube mounted at an angle to said bowstring, with said angle residing inclusively between 38° and 45°.

7. The aiming method of claim 1, further comprising a step (c-1) before step (d) of securing said cord with a knot.

8. The aiming method of claim 7, wherein said knot is selected from the set of knots comprising:

an overhand knot, a double overhand knot, a square knot, a bowline, and a clove hitch.

9. The aiming method of claim 1, further comprising a step (d-1) before step (e) of nocking an arrow to said bowstring.

10. The aiming method of claim 1, further comprising a step (d-2) before step (e) of engaging a wrist release to said bowstring.

11. A method for aiming an archery bow, comprising the steps of:

(a) providing a bow having a frame and a bowstring, (b) providing a nose button which comprises a longitudinal axis, first and second split rings spaced apart along said longitudinal axis, a plurality of connecting beams comprising at least three spanning between said first and second split rings, with said second split ring further comprising a radially spaced array of radial projections, with tips of at least two of said projections residing in a plane perpendicular to said longitudinal axis, said nose button further comprising at least one aperture having a perimeter defined between said first split ring, a first from among said plurality of connecting beams, said second split ring, and a second from among said plurality of connecting beams, (c) inserting said bowstring into said splits of said split rings and into an aligned space between connecting beams apart from said aperture, locating said nose button to a first point on said bowstring so that when drawn, one from among said radial array of projections contacts a point on an archer's nose, (d) depositing a cord between said first and second split rings and looping said cord around said bowstring to form at least one loop transverse to said bowstring and in contact through said aperture with said bowstring, (e) drawing said bowstring to a depth of draw, and (f) raising said bow so that one from among said tips of said radial projections touches said archer's nose.

12. The aiming method of claim 11, further comprising a step (g) after step (f) of:

orienting said bow so that at least one sighting aid affixed thereto aligns with a line of sight extending from said archer's eye.

13. The aiming method of claim 11, wherein said depth of draw which is controlled by a draw stop.

14. The aiming method of claim 11, wherein any one of said at least one sighting aid is selected from the set of sighting aids consisting of:

a peep sight installed at a second point along a bowstring, a bead mounted on said bow frame, a lens mounted on said bow frame, a loop mounted on said bow frame, a bead mounted on a projection extending from said bow frame, a lens mounted on a projection extending from said bow frame, a loop mounted on a projection extending from said bow frame, and a mark on said bow frame.

15. The aiming method of claim 14, wherein said sighting aid is a peep sight, and further comprising a step (b-1) after step (a) of splaying apart strands of said bowstring so that they pass around opposite sides of said sighting aid.

16. The aiming method of claim 15, wherein said peep sight comprises a tube mounted at an angle to said bowstring, with said angle residing inclusively between 38° and 45°.

17. The aiming method of claim 11, further comprising a step (c-1) before step (d) of securing said cord with a knot.

18. The aiming method of claim 17, wherein said knot is selected from the set of knots comprising:

an overhand knot, a double overhand knot, a square knot, a bowline, and a clove hitch.

19. The aiming method of claim 11, further comprising a step (d-1) before step (e) of nocking an arrow to said bowstring.

20. The aiming method of claim 11, further comprising a step (d-2) before step (e) of engaging a wrist release to said bowstring.

* * * * *